US005253840A

United States Patent [19]

Sheremetta

[11] Patent Number: 5,253,840

[45] Date of Patent: Oct. 19, 1993

[54] ADJUSTABLE BOOK REST

[76] Inventor: Beverley Sheremetta, 15 Maple Avenue, Dundas, Ontario, Canada, L9H 4W3

[21] Appl. No.: 901,292

[22] Filed: Jun. 19, 1992

[30] Foreign Application Priority Data

Feb. 28, 1992 [CA] Canada ..... 2062037

[51] Int. Cl.[5] ..... A47B 97/04

[52] U.S. Cl. ..... 248/452; 248/205.3; 248/455

[58] Field of Search ..... 248/452, 454, 455, 459, 248/460, 446, 463, 448, 456, 457, 205.3; 281/33, 45, 46, 47, 48, 49, 50

[56] References Cited

U.S. PATENT DOCUMENTS

| | | | |
|---|---|---|---|
| 1,051,047 | 1/1913 | Wood . | |
| 1,724,492 | 8/1929 | Manus . | |
| 2,587,316 | 2/1952 | Henry . | |
| 2,722,434 | 11/1955 | Wolfe . | |
| 2,982,568 | 5/1961 | Wolfe | 281/33 |
| 3,121,576 | 2/1964 | Schade | 281/33 |
| 3,366,359 | 1/1968 | Wolf et al. | 248/447 |
| 3,376,009 | 4/1968 | Domino | 248/460 X |
| 3,794,284 | 2/1974 | Guenther | 248/441 |
| 3,833,197 | 9/1974 | Dyke | 248/441 |
| 3,952,989 | 4/1976 | Hatcher | 248/460 X |
| 4,060,216 | 11/1977 | Million | 248/460 |
| 4,150,807 | 4/1979 | Manso | 248/452 |
| 4,377,271 | 3/1983 | Smith | 248/460 |
| 4,607,817 | 8/1986 | Aquino | 248/459 |
| 4,679,757 | 7/1987 | Mussari | 248/463 |
| 4,709,895 | 12/1987 | Mardak | 248/460 |
| 5,149,047 | 9/1992 | Tucker | 248/460 X |
| 5,154,391 | 10/1992 | Hegarty | 248/205.2 X |

FOREIGN PATENT DOCUMENTS

| | | | |
|---|---|---|---|
| 2702587 | 5/1978 | Fed. Rep. of Germany | 248/459 |

*Primary Examiner*—Ramon O. Ramirez
*Attorney, Agent, or Firm*—Rogers & Scott

[57] ABSTRACT

A readily adjustable and portable book rest includes a support member having a transversely extending fold line providing an upper support member portion above the fold line and a lower support member portion below the fold line. A rigid spine is secured to the upper support member portion and projects therefrom below the fold line, and a flexible adjustment strap extending from the lower support member portion is securable to the spine at different positions therealong to enable the book rest to be erected for use with the upper support member portion at a desired angle. The lower support member portion is angulated about the fold line rearwardly relative to the upper support member portion and the adjustment strap is appropriately secured to the spine to cause the desired angle to be maintained by the book rest when set down on a supporting surface with a lower edge of the lower support member portion and a lower end of the spine being supported thereby.

4 Claims, 4 Drawing Sheets

ADJUSTABLE BOOK REST

This invention relates to adjustable and readily portable book rests.

There are many occasions when a readily adjustable and portable book rest is useful, for example when an adult or child is reading in bed at home or in hospital. On such occasions, it is important that the book rest not only be readily portable but also readily adjustable in such a manner that the angle of the book relative to a reader's eyes be correctly set to suit a particular reader's preference. It is also an advantage if the book rest can be used for other purposes than reading a book, for example for supporting a writing pad or drawing paper. It is a further advantage if the book rest can be folded when not in use for convenience when carried from one place to another or when storing for future use.

Many different designs have been proposed over the years but, so far as applicant is aware, none have met all the criteria mentioned above. It is therefore an object of the invention to provide an improved book rest which can meet such criteria.

According to the invention, an adjustable and readily portable book rest comprises a support member having a transversely extending fold line providing an upper support member portion above the fold line and a lower support member portion below the fold line, a rigid spine secured to the upper support member portion and projecting therefrom below the fold line, and a flexible adjustment strap extending from the lower support member portion and securable to the spine at different positions therealong to enable the book rest to be erected for use with the upper support member portion at a desired angle by angulating the lower support member portion about the fold line rearwardly relative to the upper support member portion and appropriately securing the adjustment strap to the spine to cause the desired angle to be maintained by the book rest when set down on a supporting surface with a lower edge of the lower support member portion and a lower end of the spine being supported thereby.

The adjustment strap and the spine may each carry a strip of Velcro material to enable the adjustment strap to be secured to the spine at different locations to enable the upper support member portion to be set at different angles.

The book rest may also include a pair of clips secured to an upper edge portion of the upper support member portion on opposite sides of the spine to enable reading or writing material to be secured by the clips to the upper support member portion.

The support member may have a pair of further fold lines extending from an upper edge to a lower edge thereof on opposite sides of and adjacent to the spine to enable the binder to be folded when not in use by folding the support member about the further fold lines.

Figure 1:
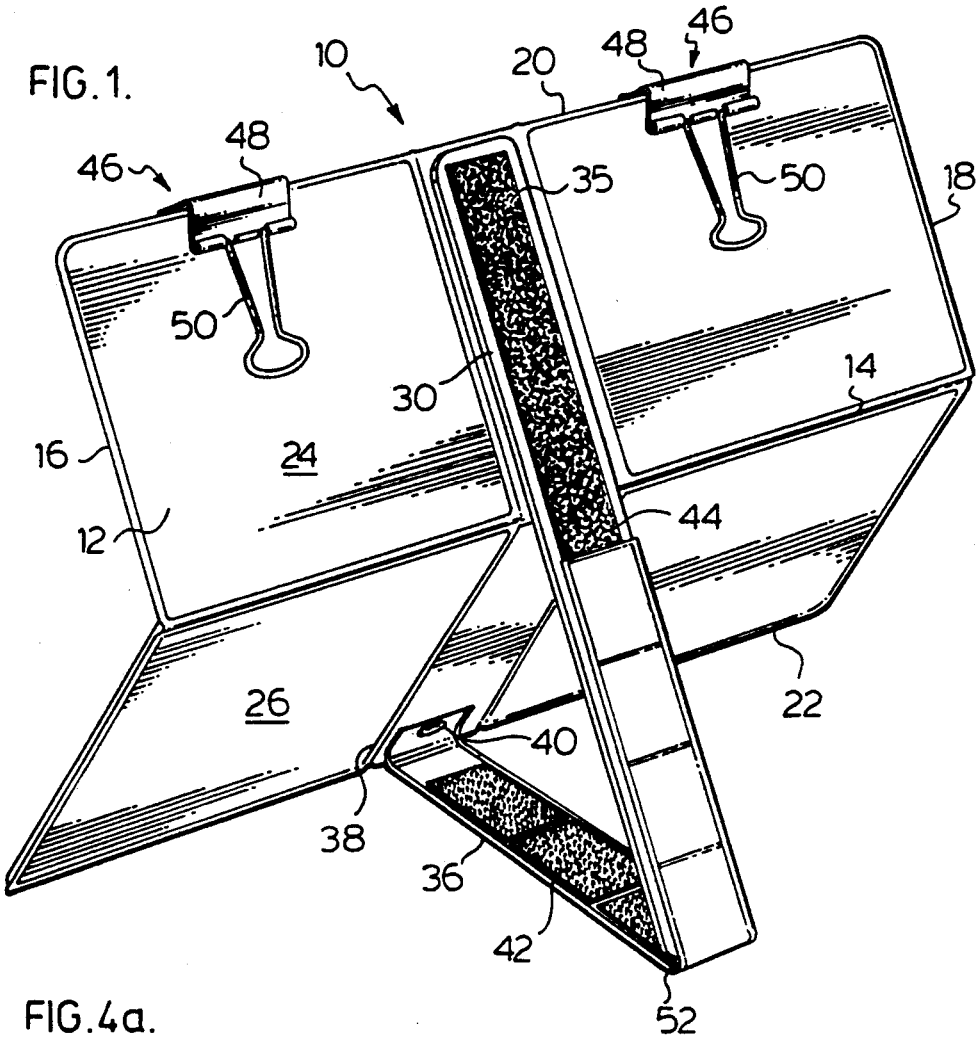
Figure 4A:
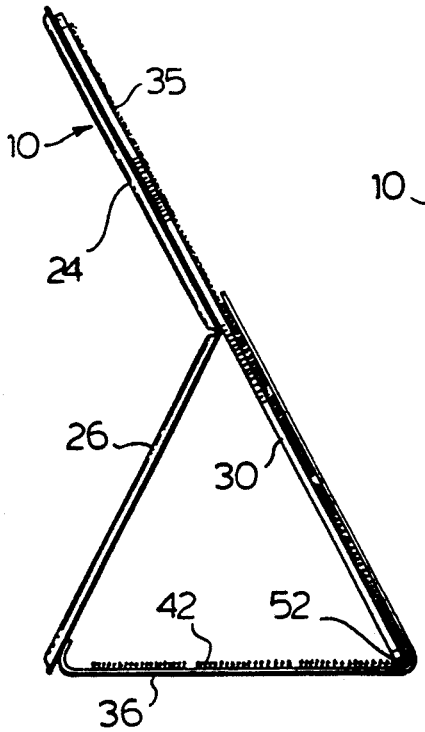
Figure 4B:
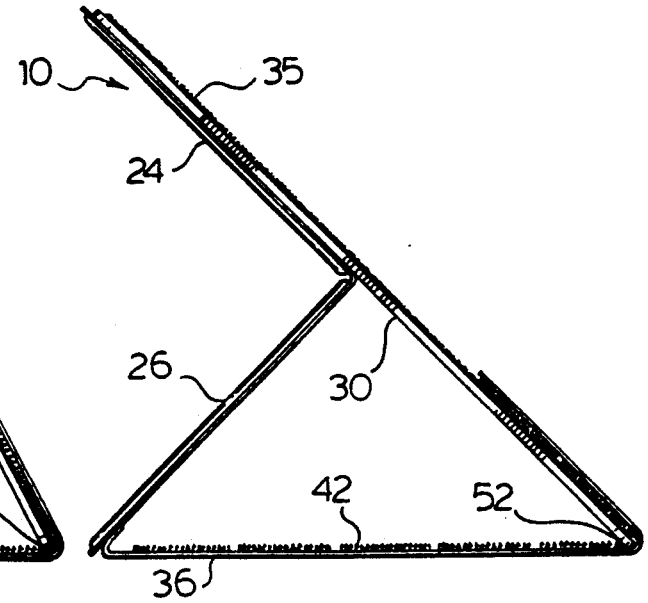
Figure 2:
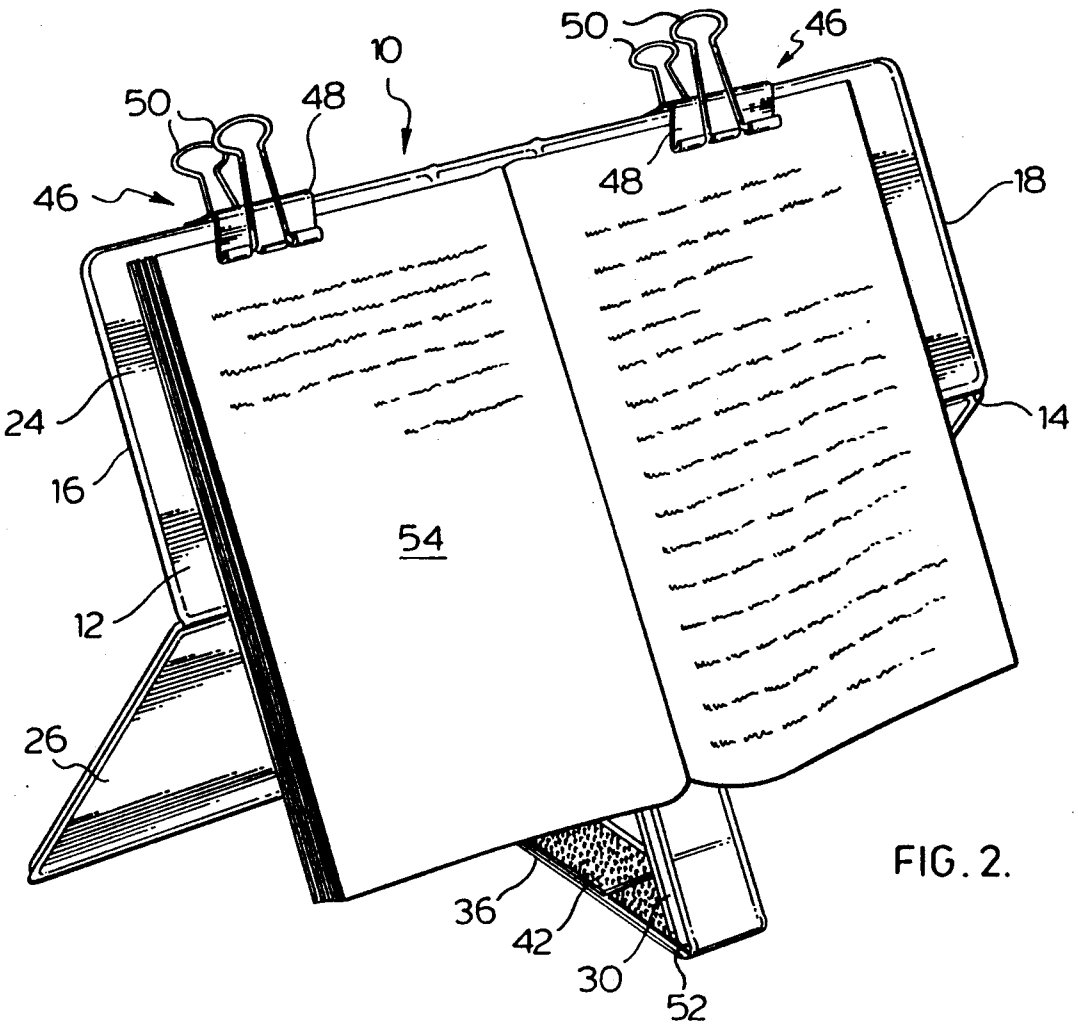
Figure 3:
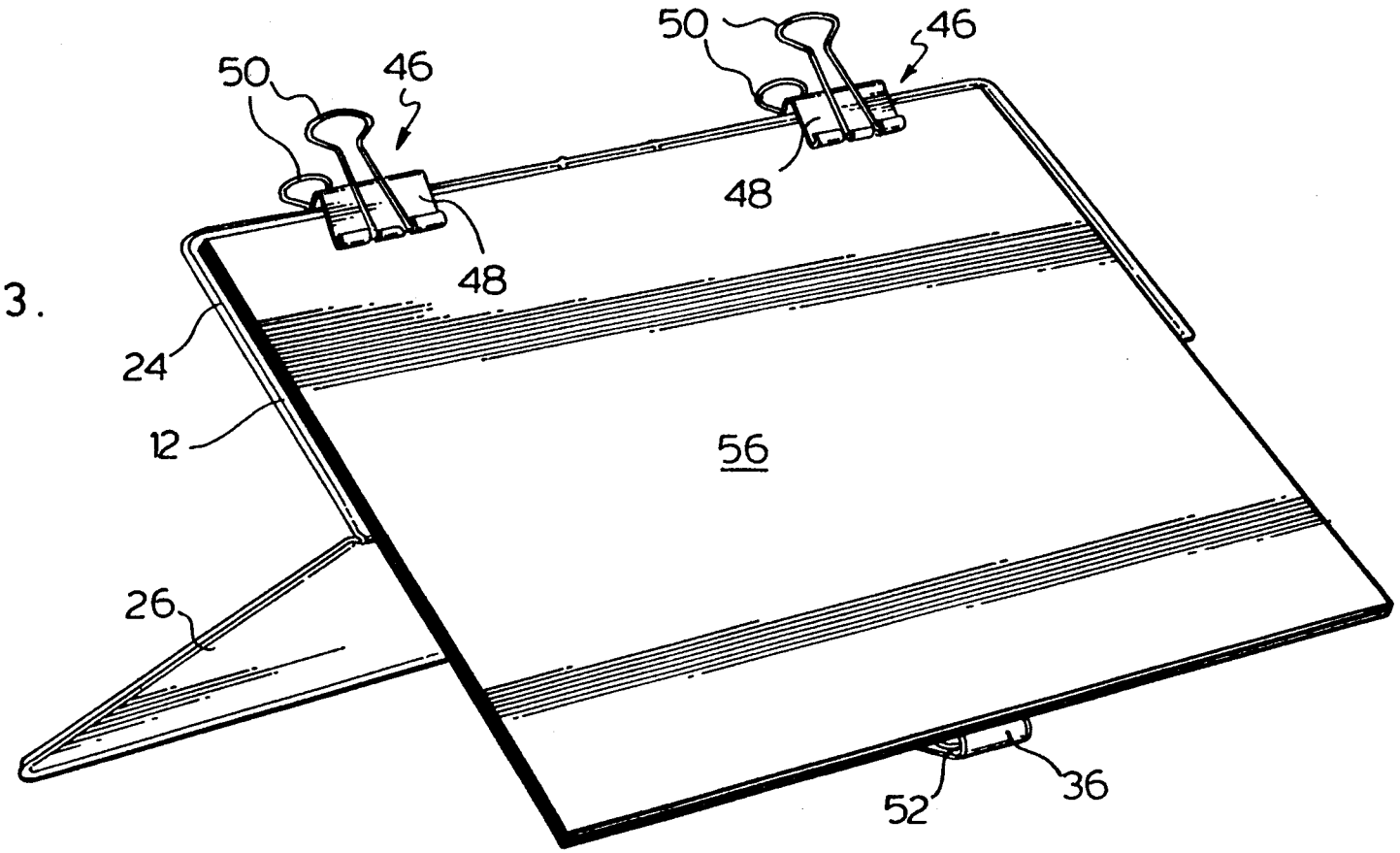
Figure 5:
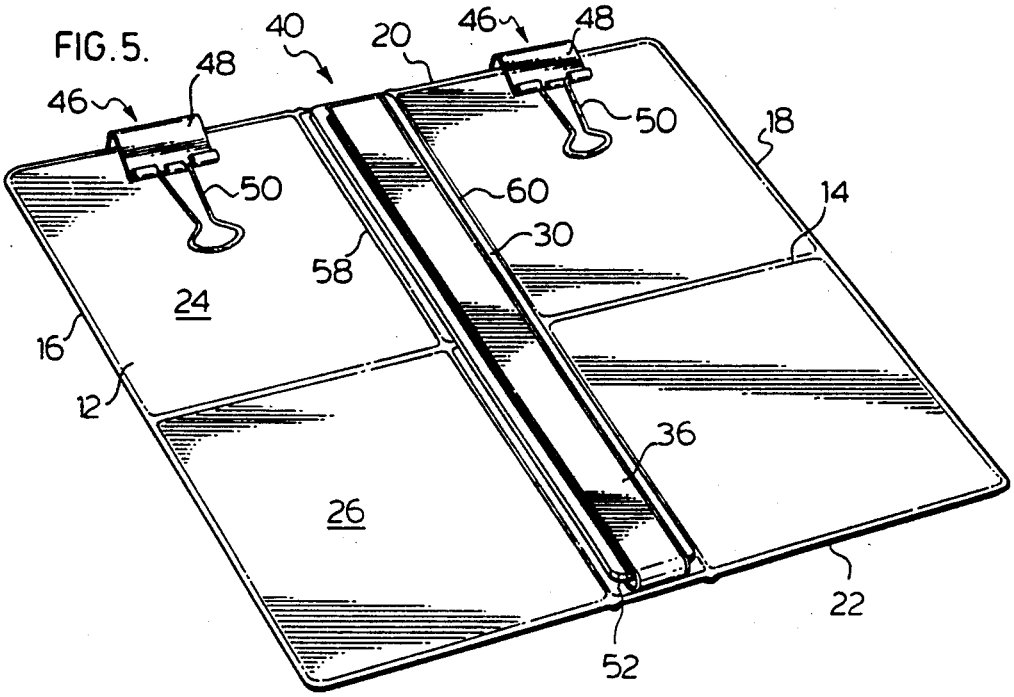
Figure 6:
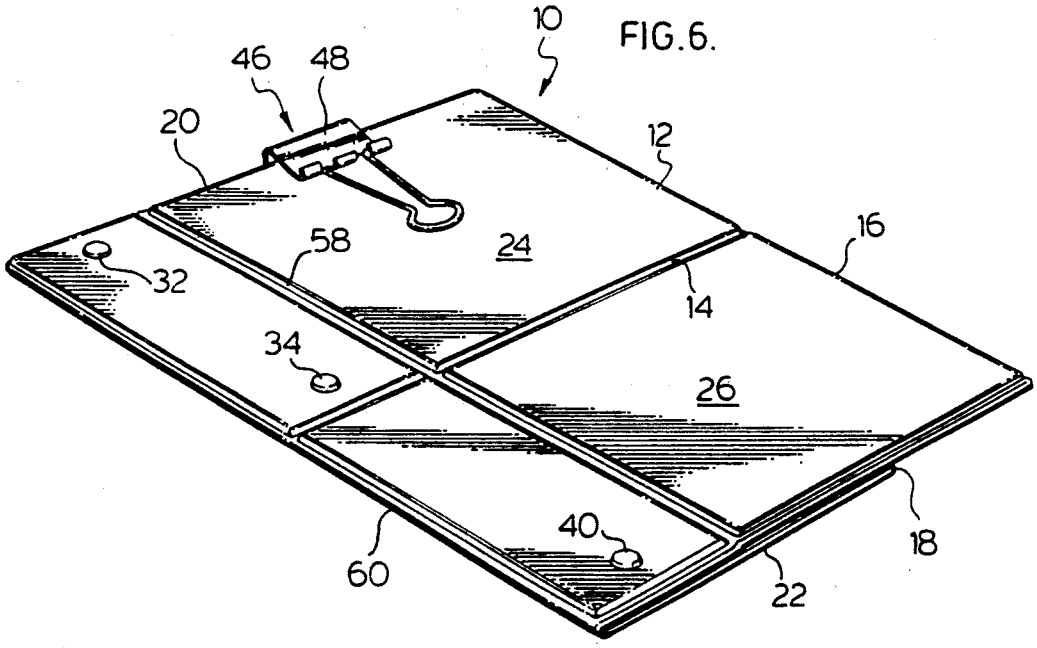

A preferred embodiment of the invention will now be described, by way of example, with reference to the accompanying drawings, of which:

FIG. 1 is a perspective view of a book rest in accordance with the invention, with the upper support member being set at a desired book-reading angle, FIG. 2 is similar to FIG. 1 but also shows a book supported by and secured to the book rest, FIG. 3 is similar to FIG. 1 but also shows a writing pad supported by and secured to the book rest, FIG. 4*a* is a side view of the book rest of FIG. 1 but shows the upper support member portion set at a different book-reading angle, the clips being omitted, FIG. 4*b* is similar to FIG. 4*a* but shows the upper support member portion set at another different book-reading angle, FIG. 5 is a perspective view showing the book rest in a semi-erected configuration, and FIG. 6 is a similar view showing the book rest in a folded configuration.

Referring to the drawings, a book rest 10 in accordance with a preferred embodiment of the invention comprises a rectangular board-like support member 12 which may be formed by a sheet of rigid board covered by appropriately colored vinyl. Such constructions are well known and therefore need not be described in further detail. The support member 12 has a transversely-extending horizontal fold line 14 (also well known per se) extending transversely across the support member 12 from one side edge 16 to the opposite side edge 18 midway between the upper edge 20 and the lower edge 22. The fold line 14 divides the support member 12 into an upper portion 24 and a lower portion 26. As will be explained in more detail later, provision of the fold line 14 enables the lower portion 26 of the support member 12 to be angled rearwardly relative to the upper portion 24.

A flat strip-like rigid spine 30, which may be of suitable plastic material, is secured to the upper portion 24 of the support member 12. The spine 30 has a length just less than the distance between the upper and lower edges 20, 22 of the support member 12 and extends downwardly across the upper portion 24 of the support member 12 from the upper edge 20 midway between its side edges 16, 18. The spine 30 is attached to the upper portion 24 of the support member 12 by two rivets 32,34, see FIG. 6, the rivet 32 being near the upper edge 20 and the rivet 34 being near the fold line 14. A first flexible strip 35 of releasable securing material such as that sold under the name Velcro (registered trade mark) is attached by suitable adhesive to the spine 30 and extends for substantially the whole of its length.

A flexible adjustment strap 36 is secured at one end 38 to the lower portion 26 of the support member 12 by rivet 40 at a position near the lower edge 22 and midway between the side edges 16, 18 of the support member 12. The adjustment strap 36 has a length approximately equal to that of the spine 30 and may be formed by a flexible strip of appropriate material covered by vinyl of the same color as that of the support member 12. A second strip 42 of releasable securing material such as Velcro is attached by suitable adhesive to the adjustment strap 36 and extends for a substantial distance from the free end 44 thereof towards the other end which is secured by the rivet 40 to the lower support member portion 26.

Book rest 10 also includes a pair of clips 46 of the kind commonly referred to as "fold back clips" i.e. with a spring part 48 for gripping an article therebetween and a pair of handles 50 each attached to an opposite side of the spring part for opening the spring part 48 to enable the clip to be attached to or removed from an article. When not in use, the handles 50 of a fold back clip can be folded over so as to be in proximity to opposite sides of the upper portion 24 of the support member 12 in inoperative and less projecting positions.

In use, and as shown in FIG. 1, the lower edge 22 of the support member 12 is rested on a support surface (not shown but which may be a bed or table) and the support member 12 is angulated by relative movement between the upper and lower portions 24, 26 about the horizontal fold line 14 so that relative to the user, the lower portion 26 extends upwardly and forwardly from the support surface, the upper portion 24 extends upwardly and rearwardly from the fold line 14, the adjustment strap 36 extends forwardly from the rivet 40 across the support surface, and the lower end 52 of the spine 30 rests on the adjustment strap 36 at a distance from its free end 44. The portion of the adjustment strap 36 between the lower end 52 of the spine 30 and the free end 44 of the strap 36 is folded upwardly and rearwardly so that part of the Velcro strip 42 on the strap 36 engages a part of the Velcro strip 35 on the spine 30 so as to retain the book rest 12 in the configuration selected, i.e. with the upper support member portion 24 at a desired angle for the intended user. The angle is easily adjusted by varying the length of the Velcro strip 42 on the adjustment strap 36 attached to the Velcro strip 35 on the spine 30, as shown in FIG. 4.

FIG. 2 shows how a book 54 can easily be secured to the book rest 10 by means of the clips 46. Pages of the book may be held in place by folding the forward handle 50 of one or both clips 46 downwardly over a page or pages. FIG. 3 shown how a writing pad 56 can also easily be secured to the book rest 10 by means of the clips 46. It will be noted that the book 54 and the writing pad 56 are suspended from the clips 46.

For ease in carrying the book rest from one place to another and when storing for future use, the support member 12 may also be provided with two fold lines 58,60. These further fold line 58, 60 extend from the upper edge 20 to the lower edge 22 of the support member 12 on opposite sides of and immediately adjacent to the spine 30. The book rest 10 can then be folded from the erected position previously shown by first angling the upper and lower support member portions 24, 26 to a flat board-like configuration. Adjustment strap 36 is then detached from the spine 30 and pulled towards the upper end of the spine, i.e. towards the upper edge 20 of the support member 12, so that the adjustment strap 36 can be re-attached to spine 30 in a position in which the adjustment strap 36 lies along the spine 30 as shown in FIG. 5. The portions of the support member 12 on opposite sides of spine 30 can then be folded towards one another about the fold lines 58, 60, as shown in FIG. 6.

The advantages of the invention will be clearly apparent from the foregoing description and illustration of a preferred embodiment. Other embodiments will be readily apparent to a person skilled in the art, the scope of the invention being defined in the appended claims.

I claim:

1. A readily adjustable and portable book rest comprising a support member having a transversely extending fold line providing an upper support member portion above the fold line and a lower support member portion below the fold line, a rigid spine secured to the upper support member portion and projecting therefrom below the fold line, and a flexible adjustment strap extending from the lower support member portion and securable to the spine at different positions therealong to enable the book rest to be erected for use with the upper support member portion at a desired angle by angulating the lower support member portion about the fold line rearwardly relative to the upper support member portion and appropriately securing the adjustment strap to the spine to cause the desired angle to be maintained by the book rest when set down on a supporting surface with a lower edge of the lower support member portion and a lower end of the spine being supported thereby, the adjustment strap and the spine each carrying a strip of Velcro material, the strip of Velcro material carried by the spine extending over substantially the whole length of the spine, to enable the adjustment strap to be secured to the spine at different locations to enable the upper support member portion to be set at different angles.

2. A book rest according to claim 1 also including a pair of clips secured to an upper edge portion of the upper support member portion on opposite sides of the spine, said clips being operable to suspend reading or writing material therefrom to enable reading or writing material to be secured by the clips to the upper support member portion.

3. A book rest according to claim 1 wherein the support member has a pair of further fold lines extending from an upper edge to a lower edge thereof on opposite sides of and adjacent to the spine to enable the book rest to be folded when not in use by folding the support member about the further fold lines.

4. A readily adjustable and portable book rest comprising a support member having a transversely extending fold line providing an upper support member portion above the fold line and a lower support member portion below the fold line, a rigid spine secured to the upper support member portion and projecting therefrom below the fold line, a flexible adjustment strap extending from the lower support member portion and securable to the spine at different positions there along to enable the book rest to be erected for use with the upper support member portion at a desired angle by angulating the lower support member portion about the fold line rearwardly relative to the upper support member portion and appropriately securing the adjustment strap to the spine to cause the desired angle to be maintained by the book rest when set down on a supporting surface with a lower edge of the lower support member portion and a lower end of the spine being supported thereby, and a pair of clips secured to an upper edge portion of the upper support member portion on opposite sides of the spine, said clips being operable to suspend reading or writing material therefrom to enable reading to writing material to be secured by the clips to the upper support member portion.

* * * * *